United States Patent [19]

Turlais

[11] 4,004,111

[45] Jan. 18, 1977

[54] HORN TESTING DEVICE

[75] Inventor: Juris Turlais, Marion, Ind.

[73] Assignee: United Filtration Corporation, Marion, Ind.

[22] Filed: Sept. 18, 1975

[21] Appl. No.: 614,497

[52] U.S. Cl. ..... 179/175.1 A

[51] Int. Cl.[2] ..... H04R 29/00

[58] Field of Search ..... 179/175.1 A, 1 P, 1 C; 73/1 DV; 181/33 G

[56] References Cited

UNITED STATES PATENTS

| | | | |
|---|---|---|---|
| 1,973,081 | 9/1934 | Keiser | 179/1 C |
| 2,224,909 | 12/1940 | Hackley | 179/175.1 A |
| 2,394,613 | 2/1946 | Houlgate et al. | 179/175.1 A |
| 2,558,550 | 6/1951 | Fiske | 179/175.1 A |
| 2,806,544 | 9/1957 | Witchey | 179/175.1 A |
| 3,725,584 | 4/1973 | Kilmer et al. | 179/1 C |

*Primary Examiner*—Douglas W. Olms
*Attorney, Agent, or Firm*—Kinzer, Plyer, Dorn & McEachran

[57] ABSTRACT

An apparatus and method for testing electric horns. A sound-detecting fixture includes an elongated progressive wave tube containing a mass of sound-absorptive material and a means for seating a horn adjacent one end of the tube. Sound detecting means are interposed between the horn and sound-absorptive material to detect the sound level output of the horn. A sound audit station includes a source of electric power for the horn and an amplifier and display indicator for presenting the horn sound-level signals.

2 Claims, 5 Drawing Figures

D.C. HOOKUP

A.C. HOOKUP

HORN TESTING DEVICE

SUMMARY OF THE INVENTION

This invention relates in general to sound-detecting instruments and more particularly to a sound-detecting fixture and method for testing electric horns.

A sound-detecting fixture for testing electric horns is provided which includes an elongated progressive wave tube, one end of which is adapted to receive sound from a horn being tested. A mass of sound absorptive material is spaced from that end and substantially fills a partial length of the tube. Means are provided for seating a horn adjacent the one end of the tube and sound-detecting means are interposed within the tube between the horn and mass of sound-absorptive material. One application of the horn testing device of the present invention is in a sound audit station which further includes a source of electric power and electrical connecting means between the source and horn. A sound level amplifier adjusts signals from the sound-detecting means to properly actuate a display indicator which presents a direct readout of the horn sound level.

The present invention is further directed to the method of testing electric horns which includes the steps of positioning a horn adjacent one end of a progressive wave tube, surrounding the horn with sound absorptive material, connecting a source of electric power to the horn, detecting sound within the progressive wave tube and producing sound level signals indicative thereof, amplifying the sound level signals and converting the signals to a form indicative of the horn sound level.

A primary object of the present invention is a sound-detecting fixture for testing electric horns which may provide an objective measurement of horn sound levels during the final adjustment and testing operations of a horn assembly line.

A related object is a horn testing fixture which may be inexpensively constructed and which is capable of quickly, easily and safely testing a multitude of electric horn devices.

Another object is a horn testing fixture which substantially reduces horn noise exposure to a horn testing operator.

Similarly, a specific object is a horn testing fixture in which a horn being tested is situated in a nest of sound absorptive material to substantially contain the sound of the horn within the horn testing fixture.

Another object is a horn testing fixture having a progressive wave tube designed according to the octave band center frequency of the particular type of horn being tested.

Another object is a horn testing fixture having a transparent cover plate which provides clear horn visibility to facilitate adjustment of the horn during the testing operation.

Another object is a sound audit station on a horn assembly line for quickly and easily testing and adjusting the horns being produced.

Another object is a sound audit station which is flexible in that it may be used to test various types of horns with different sound level outputs.

A further object is a new and improved method of testing electric horns.

Similarly, it is an object of the present invention to provide a method of testing electric horns which may be accomplished quickly and easily and by which method, horn noise exposure to a horn testing operator is substantially reduced.

Other objects will appear in the ensuing specification, drawings and claims.

DESCRIPTION OF THE PREFERRED EMBODIMENT

Figure 2:
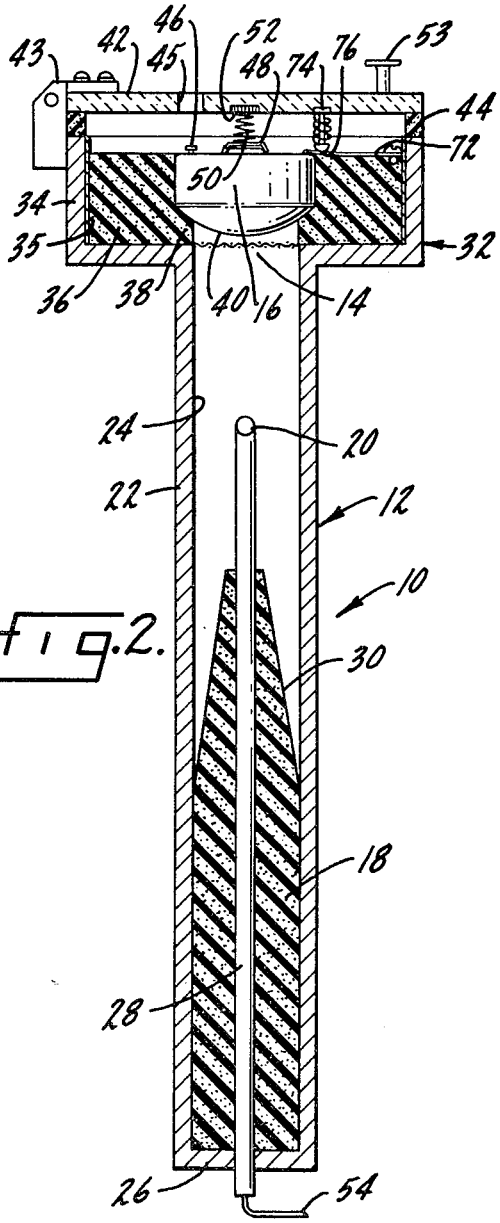
FIG. 2 is a side section view taken approximately along line 2—2 of FIG. 1.
Figure 1:
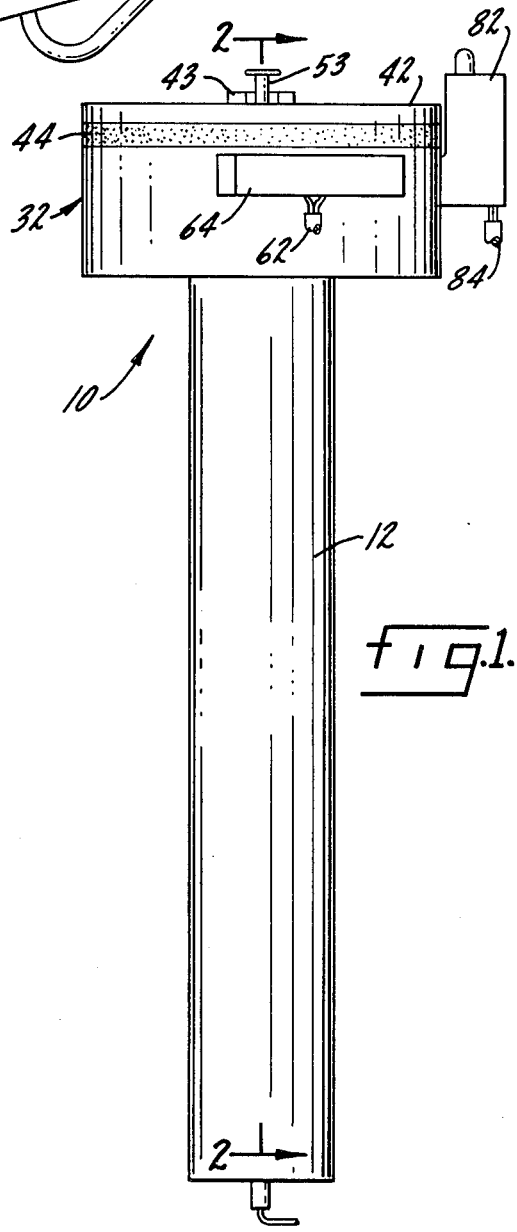
FIG. 1 is a side elevation view of a sound-detecting fixture constructed in accordance with the present invention

A sound-detecting fixture 10 is shown in FIGS. 1 and 2, which fixture includes an elongated progressive wave tube 12. One end 14 of the tube 12 (FIG. 2) is generally open to receive sound from a horn 16 which is being tested. A mass of sound absorptive material 18 substantially fills a partial length of tube 12 at a position spaced from end 14. Sound-detecting means, such as the microphone 20, is interposed within the progressive wave tube 12 between end 14 and the mass of sound-absorptive material 18 to electrically detect sound emitted from horn 16 during testing.

The progressive wave tube 12 consists of a generally cylindrical elongated pipe. Although a suitable pipe could be provided having a linear sided cross sectional shape, the cylindrical form is preferred because of its fixed radius which results in a uniform inner sound reflective surface. The dimensions of the pipe and sound-absorptive material 18 are chosen for the alarm's octave band center frequencies as is explained in further detail below. The wall 22 of the progressive wave tube is massive and stiff to provide a hard sound-reflective inner surface 24. At the bottom of the progressive wave tube, a plate 26 is attached by welding or other suitable means to close and seal that end of the tube. Similarly, a plug could be screwed into or onto the bottom end to accomplish the same result. In embodiments where the sound from a horn being tested is incapable of penetrating the mass of sound-absorptive material to reach the bottom end of the tube, the bottom plate 26 could be dispensed with. It is preferred, however, to include the bottom plate even in such circumstances, since it also functions to retain the mass of sound-absorptive material within the tube, to support a microphone stem 28 and to seal the bottom of the tube to prevent pressure variations and exposure to atmospheric dirt and moisture. Likewise, although the other end 14 of the progressive wave tube is generally open to receive sound from a horn being tested, it may be covered by a dust cover or other sound permeable material so long as it causes no substantial interference with the transmission of sound from the horn into the progressive wave tube.

The mass of sound-absorptive material 18 within the progressive wave tube has an upper surface which tapers inwardly and upwardly to form an anechoic wedge 30. It is preferred that the material taper inwardly from all sides so that the wedge is shaped somewhat like an inverted cone.

The particular type of sound-absorptive material used is not critical to the present invention but rather is a matter of design choice. Many types of such material such as glass wool or rock wool are well known in the art.

The dimensions of the progressive wave tube 12 and sound-absorptive material 18 were chosen to eliminate standing waves and cross modes. To accomplish this, the length of the progressive wave tube as well as the depth of the sound-absorptive material 18 are at least a quarter wave length long at the lowest frequency of interest for the type of horn being tested.

In order to minimize the required length of the progressive wave tube 12, it is preferred that the mass of sound-absorptive material 18 engages the bottom plate 26 and fills a substantial portion of the tube. This is also desirable as a means of properly positioning the sound-absorptive material within the progressive wave tube. In other embodiments, it may be desirable to provide a longer tube in which the position of the sound-absorptive material 18 is variable according to the sound characteristics of a particular type of horn to be tested.

A horn mounting, referred to generally by reference character 32, is shown in FIGS. 1 through 4 in its position at the top of the progressive wave tube 12. Whereas the progressive wave tube 12 itself has a diameter approximating that of the horn 16 or the sound-emitting portion of a horn being tested, the horn mounting 32 has a larger diameter to accommodate seating and insulating the horn during testing. The mounting consists basically of a generally bowl-shaped open-bottomed housing 34 (FIG. 2) which overlies end 14 of the progressive wave tube. The housing 34 may be secured on the end of the progressive wave tube by welding, screw threads or any other suitable means.

Lining the housing 34 is a copper laminated electromagnetic noise interference shield 35 that is used to reduce the electromagnetic interference, generated by direct current horns under test, from interferring with any nearby electronic equipment. The electromagnetic noise interference shield 35 may be a thin copper laminate strip bent around the inside of housing 34 with the width of the strip 35 approximating the depth of the inside of housing 34. The shield 35 is electrically connected to horn lead wires as is explained in detail below.

The horn 16 is surrounded within the horn-mounting housing 34 (FIG. 2) by a generally annular ring 36 of sound-absorptive material. Besides insulating the horn from the horn-mounting housing 34, the sound-absorptive material 36 reduces the pressure build-up in the cavity behind the horn, which pressure build-up has been found to be effective to change the sound level output of the horn.

A soft inner annular shoulder 38 of the sound-absorptive material 36 is interposed between the horn and housing 34 to support it during testing. Shoulder 38 should be soft enough so that the force of the weight of the horn 16 being tested is sufficient to form an airtight seal with end 14 of the progressive wave tube for the purpose of minimizing horn noise in the testing room. The annular ring of sound-absorptive material 36 with shoulder 38 thus forms a nest for receiving a supporting the horn for testing, which nest may be provided as a replaceable insert. Shoulder 38, which could also be formed as a separate annular gasket, is likewise effective to contain airborne sound, which is emitted from the front 40 of the horn, within the progressive wave tube and to eliminate the transmission of structure borne sound into the horn-mounting housing 34 or walls 22 of the progressive wave tube.

A hinged cover plate 42 closes the top of the horn-mounting housing 34 above the horn. The plate is fastened to a hinge 43 which is in turn secured on the mounting housing 34. An annular gasket 44 may be provided to form a seal between the cover plate 42 and rim of the horn-mounting housing 34 when the cover plate is closed. It is preferred that the cover plate be constructed of a clear plastic or glass so as to be transparent for providing visual aid for making horn adjustments during the testing operation. A small opening 45 is provided in the cover plate for the insertion of a screw driver or other horn adjustment tool to properly adjust the sound level output of the horn. This is commonly done by rotating a horn adjustment screw 46 in one direction or the other to increase or decrease the sound level output of the horn to the desired level. For horns with an adjustment screw which does not face cover plate 42, it may be necessary to provide an opening through the horn-mounting housing 34 and sound-absorptive material 36, but the transparent cover plate will still aid in assuring that the horn maintains its correct positional relationship to such opening once the cover plate is closed for testing.

The cover plate 42 is further provided with a spring-loaded gasket 48 (FIG. 2) which bears against the horn when the cover plate is closed to equalize the internal horn air pressure. Gasket 48 is mounted on the end of a spring 50 which is fastened into the underside of cover plate 42 at 52 to urge the horn downwardly against shoulder 38 when the cover is closed. Fastening means such as a screw or clip may be provided to retain the cover plate in its closed position against the urging of spring 50 or the horn test operator may simply press his hand against the plate to seal it for the relatively quick horn testing operation. A knob or handle 53 may be provided on the top of cover 42 to facilitate lifting the cover plate once testing is completed.

To detect the sound level of the horn within the progressive wave tube, a microphone 20 or equivalent sound-detecting means is interposed within the progressive wave tube between upper end 14 and the mass of sound-absorptive material 18. In FIG. 2, the microphone 20 is shown as supported at the top of a microphone stem 28 through which microphone wires 54 are carried through the bottom plate 26 of the progressive wave tube. Microphone 20 may be, for example, an electret microphone powered by a D.C. battery. A wireless sound-detecting means may be desirable in certain circumstances, but generally the additional expense of such means is unnecessary for a stationary acoustical test station in which the progressive wave tube is commonly installed.

Figure 3:
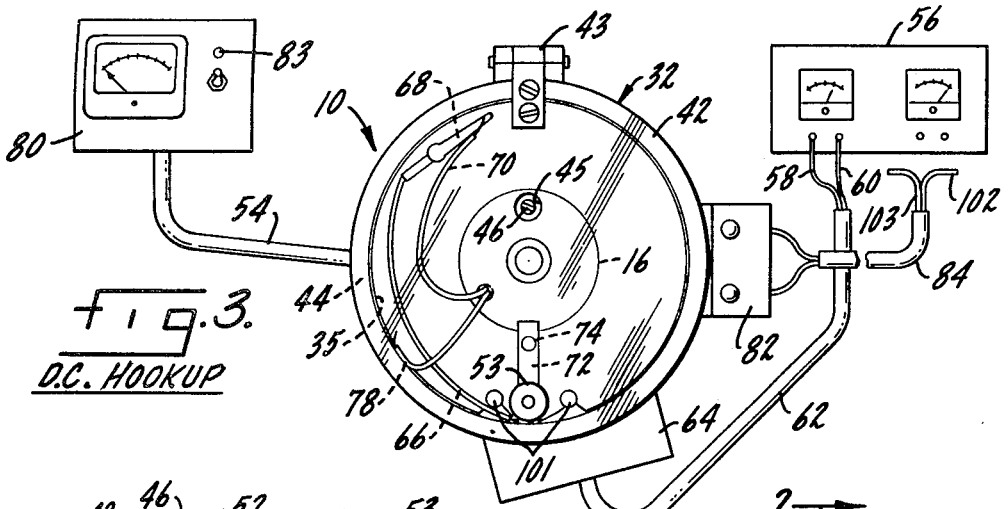
FIG. 3 is a top plan view of the sound-detecting fixture connected to other elements of the sound audit station, depicted in a smaller scale, for testing D.C. horns.
Figure 4:
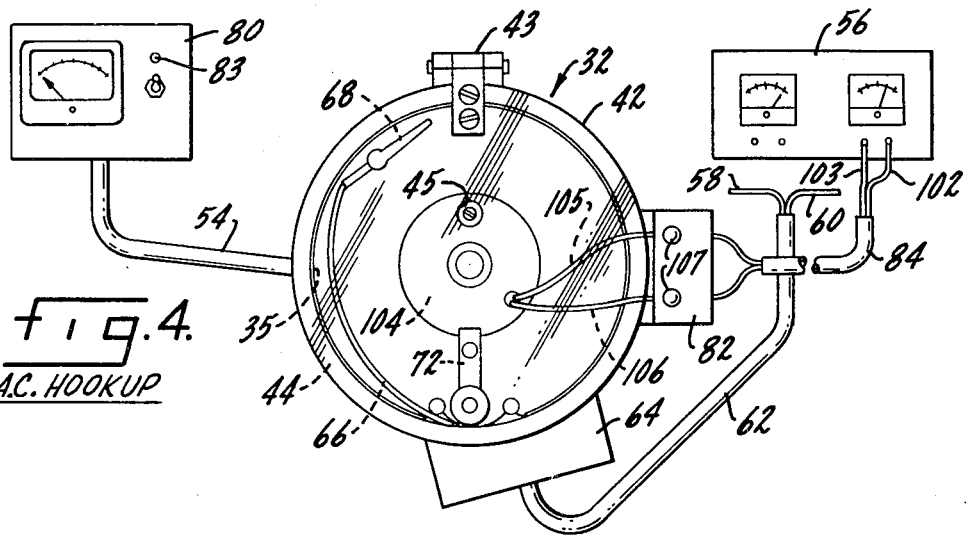
FIG. 4 is like FIG. 3 but with the sound-detecting fixture set up for testing A.C. horns.

Such an acoustical test station is illustrated in FIGS. 3 and 4, set up for testing D.C. and A.C. horns respectively. A power unit 56 is provided which can supply either A.C. or D.C. electrical power at whatever voltage is required. Electrical connecting means are provided between the power source 56 and the sound-detecting fixture 10, which connecting means includes alternate connecting means between the sound-detecting fixture and source of electric power for actuating both A.C. and D.C. horns.

In its D.C. hook-up as shown in FIG. 3, the electrical connecting means of the sound-detecting fixture utilize D.C. power lines 58 and 60 of wire 62. Power lines 58 and 60 are electrically connected to a sound-detecting fixture terminal block 64.

Terminal block 64 may be mounted on the outer wall of the horn-mounting housing 34. To electrically connect terminal block 64 to a D.C. horn 16 which is being tested, a lead wire 66 extends into the horn mounting 32 through housing 34 at a point above the sound-absorptive material 36. Wire 66 is provided with a clamp connector 68 which is adapted to be connected to the hot wire lead 70 of a D.C. horn 16 which is being tested. The horn is grounded through a clip 72 (FIG. 3) which extends radially into the horn mounting 32 from terminal block 64, far enough to partially overlie a horn positioned for testing. As shown in FIG. 2, cover plate 42 may be provided with a spring loaded contact pin 74 which is effective to depress clip 72 against the D.C. horn 16 once the cover plate is closed. The contact pin 74 may be provided with a head 76 or other contact surface of electrically insulative material.

Connected to lead wire 66 and clip 72 respectively are a pair of EMI filter capacitors 101 which are also connected to opposite ends of noise interference shield 35 within housing 34. The EMI filter capacitors 101 are used on lead wire 66 and clip 72 to reduce EMI from being propagated back through the lines. If the D.C. horn is provided with a separate coil wire such as 78 in FIG. 3, it may be simply placed inside the mounting housing 34 and cover plate gasket 44 during testing. Thus D.C. power may be provided to the terminal block 54 of the sound-detecting fixture which is further connected to the horn through the power lead 66 and clip 72 to actuate the horn.

The alternate A.C. alarm hook-up of the sound-detecting fixture is shown in FIG. 4. The electrical connecting means in this instance include A.C. power lines 102 and 103 of wire 84 which are electrically connected at one end to A.C. terminals of power source 56 and at the other to a sound-detecting fixture spring-loaded terminal block 82.

The spring loaded terminal block 82 may be mounted on the outer wall of the horn mounting housing 34 by any suitable means. To electrically connect terminal block 82 to an A.C. or Rectified A.C. horn 104 which is being tested, horn wires 105 and 106 are inserted into spring loaded slots inside of terminal block 82. Push buttons 107 protrude from the top of terminal block 82 for the purpose of manually opening the spring-loaded contacts of the terminal block for insertion of the A.C. horn wires 105 and 106.

To measure the sound level output of either the D.C. horn 16 or A.C. horn 104 once the horn is actuated, the sound-detecting means or microphone 20 is connected through lead 54 to a sound level amplifier and readout unit 80. The amplifier and readout unit 80 may be operated with a D.C. power supply or an internal battery power input. Where the electret microphone 20 is powered by a D.C. battery which may be housed within the sound level amplifier 80, it may be desirable to indicate with an LED whether the sound level amplifier battery is weak or not. Accordingly, a light-emitting diode or LED 83 may be mounted on the sound level amplifier 80. If the battery is weak, the LED will glow faintly or extinguish.

Figure 5:
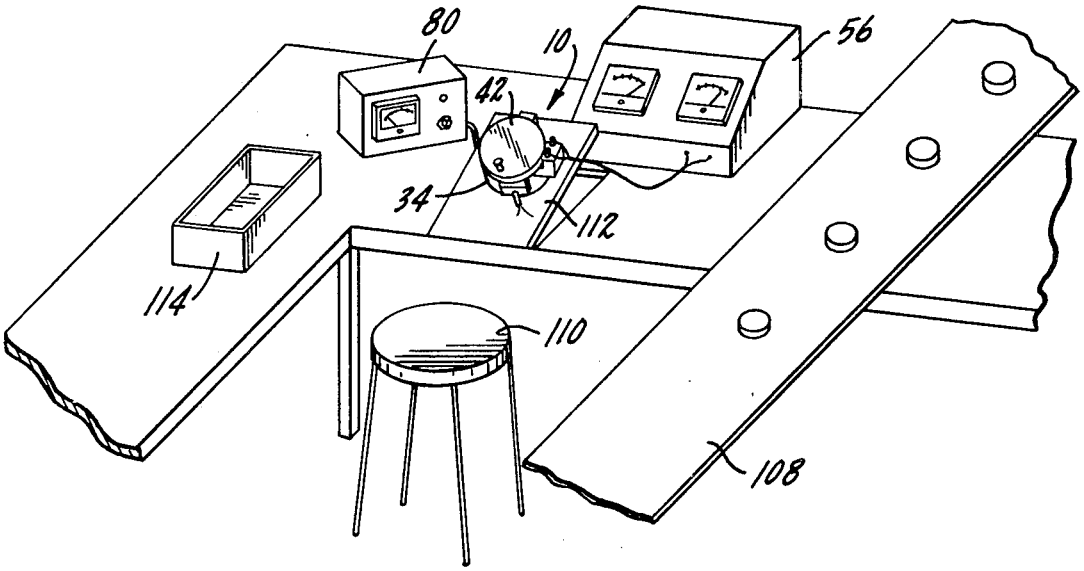
FIG. 5 is a perspective view of a typical sound audit station constructed in accordance with the invention.

To use, operation and function of the invention are as follows:

The use of the sound-detecting fixture of the present invention is described in connection with its installation in a sound audit station or acoustical test station as may be found on an assembly line in a horn production plant. A typical sound audit station is shown in FIG. 5. A conveyor 108 delivers horns to a horn testing operator positioned conveniently adjacent the conveyor such as on stool 110. The sound-detecting fixture 10 may be mounted on an inclined surface 112 facing the horn testing operator so that the top of the horn-mounting housing 34 and hinged cover plate 42 are within easy reach of the horn testing operator. Likewise, the power source 56 and display indicator 80 are positioned in the direct view of the horn testing operator. Horns to be tested may thus be delivered to one side of the station on conveyor 108, tested and then packed in a shipping crate 114 or otherwise removed from the sound audit station.

To test a particular horn, the operator would open the hinged cover plate 42 and insert the horn into the alarm mounting 32 so that it rests on the annular gasket 38.

For testing D.C. horns (FIG. 3), power lines 58 and 60 are connected to the D.C. terminals of power source 56 and the clamp connector 68 of power lead 66 is clamped onto the hot line 70 of the D.C. horn 16. As the horn testing operator then closes cover plate 42, contact pin 74 forces clip 72 into engagement with the surface of the D.C. horn to complete the electrical connection between the power source 56 and horn 16.

For testing A.C. horns (FIG. 4) A.C. power lines 102 and 103 are connected to A.C. terminals of power source 56. The push buttons 107 of terminal block 82 are then depressed in order to allow the insertion of A.C. horn wires 105 and 106 into the spring loaded slots of the terminal block 82 to which they are electrically connected upon release of the push buttons.

As the horn being tested is thus actuated, the sound is emitted primarily into the progressive wave tube 12 since the horn is otherwise generally insulated within the horn mounting 32 by the sound-absorptive material 36. Likewise, little sound is emitted from the progressive wave tube since it is substantially absorbed by the mass of sound-absorptive material 18. But the sound level output of the horn within the progressive wave tube above the mass of sound absorptive material 18 is detected by the microphone 20 which provides an electrical signal through wire 54 to the sound level amplifier 80. The sound level amplifier and readout unit 80 preferably has a calibration potentiometer and a sound level adjustment switch for different sound level settings for measuring several levels of decibel output. Thus, the sound audit station is flexible and can be used for measuring the sound level output of several types of horns. The dial indicator portion of meter 80 receives the amplifier signals of microphone 20 and provides a direct readout of the correlated sound level of the horn being tested.

Should meter 80 indicate that adjustment or tuning of the horn is necessary to provide an audible output that meets the required specifications, the horn testing operator inserts the screw driver or other tool through the opening 45 in cover plate 42 to rotate the horn adjustment screw 46 which is easily visible through the transparent cover plate 42. Once the sound level output is brought within the proper range, the adjustment tool may be removed and the cover opened so that the horn may be disconnected and removed from the mounting 32 and returned to the assembly line for packaging or whatever other operations are scheduled.

Should the LED 83 begin to glow only faintly or extinguish during the testing operation, the horn testing operator should discontinue testing until the D.C. battery is checked and recharged to its proper voltage level or replaced. It is preferred that the sound audit station be calibrated and checked for calibration on a daily basis. Such calibration can be accomplished using standard horns which have been cross-checked with a commercial sound meter to assure they are properly adjusted for this purpose. Similarly, daily inspection and cleaning as well as adjusting whenever necessary, are recommended in order to maintain the sound audit station in its operating condition.

A novel method of testing electric horns is presented in the above described operation of the present invention. The method includes positioning a horn adjacent one end of a progressive wave tube containing a mass of sound-absorptive material within the tube and spaced from that end. The horn is surrounded therein with sound-absorptive material to substantially contain the sound of the horn within the progressive wave tube. The horn is connected to a source of electric power to actuate it, with the sound emitted therefrom being detected within the progressive wave tube. Sound level signals indicative of the horn sound level are produced, adjustably amplified and converted to a form indicative of the sound level of the horn to a horn testing operator.

The method may further include substantially enclosing the horn, such as with sound absorptive material, during testing in order to reduce the horn noise exposure to a horn testing operator and shielding electromagnetic noise interference generated by D.C. horns during testing.

Thus the present invention provides a means of testing various types of electric horns having different decibel output levels, while at the same time protecting the horn testing operator from the noise levels which the horns are designed to create. Electric horns, and specifically electric alarms, may be of the straight A.C. type, Rectified A.C. type, or D.C. type. Furthermore, manufacturing tolerances require that the alarms be properly tuned to provide an audible output that meets the required specifications for that particular alarm. Thus, the sound audit station of the present invention provides a flexible power input capable of providing A.C. or D.C. power at various voltage levels. The sound level amplifier is adjustable to vary the scale of the display indicator so that several different sound level outputs may be detected and displayed. The horn itself is surrounded during testing by sound-absorptive material designed to minimize the transmission of sound to and from the horn mounting and the progressive wave tube is provided with hard reflective inner surfaces and the anechoic wedge of sound-absorptive material to minimize the transmission of sound from the progressive wave tube. The dimensions and shape of the progressive wave tube and wedge of sound-absorptive material therein are themselves designed for the alarm's octave band center frequencies to further prevent the transmission of sound to the atmosphere around the progressive wave tube.

Thus, there has been provided in accordance with the present invention a sound-detecting fixture and method that fully satisfies the objects and advantages set forth above. While a preferred form of the invention has been disclosed, it should be understood that additional modification, changes, substitutions and variations may be made without departing from the invention's fundamental theme.

I claim:

1. A sound-detecting fixture for testing electric horns, comprising an elongated progressive wave tube, one end being adapted to receive sound from a horn being tested, means for seating a horn adjacent said one end of the progressive wave tube so that sound emitted from the horn is directed into the tube, a mass of sound-absorptive material within the progressive wave tube, spaced from said one end and substantially filling a partial length of the tube, sound-detecting means interposed within the progressive wave tube between said one end and the mass of sound-absorptive material, the mass of sound-absorptive material having an upper surface facing said one end of the tube, said upper surface being generally conical, the other end of the progressive wave tube being closed and the mass of sound-absorptive material engaging said other end and filling a substantial portion of the tube, the sound-detecting means comprising a microphone, said microphone being mounted in a generally fixed position within the progressive wave tube, the progressive wave tube comprising a generally cylindrical, elongated pipe having a hard reflective inner surface, said means for seating a horn comprising a generally bowl-shaped horn mounting overlying said one end of the progressive wave tube, said mounting being of greater diameter than the progressive wave tube and containing an annular body of sound-absorptive material for surrounding a horn and an inner annular shoulder of such material for supporting a horn to be tested, the horn mounting including a removable and generally transparent cover for closing and sealing the mounting, said mounting having an aperture therethrough through which horn adjustment may be made during testing, and an annular electromagnetic noise interference shield disposed between the horn mounting and annular body of sound-absorptive material for reducing electromagnetic interference during the testing of D.C. horns.

2. A sound-detecting fixture according to claim 1 further comprising electrical contact means operatively engageable with a horn seated in the horn mounting to actuate the horn, and electromagnetic interference filter capacitor electrically connected between said contact means and the noise interference shield to reduce the propagation of interference back through the contact means.

* * * * *